US006414055B1

(12) United States Patent
Lauzon

(10) Patent No.: US 6,414,055 B1
(45) Date of Patent: Jul. 2, 2002

(54) METHOD FOR PREPARING AQUEOUS SIZE COMPOSITION

(75) Inventor: Rodrigue V. Lauzon, Bear, DE (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 09/558,429

(22) Filed: Apr. 25, 2000

(51) Int. Cl.[7] ..... C08J 5/10; C08L 89/00
(52) U.S. Cl. ..... 524/47; 524/52; 524/53
(58) Field of Search ..... 524/47, 51, 52, 524/53, 531, 197, 114, 319

(56) References Cited

U.S. PATENT DOCUMENTS

| | | | | |
|---|---|---|---|---|
| 4,040,900 | A | 8/1977 | Mazzarella et al. | 162/158 |
| 4,207,142 | A | 6/1980 | Shepherd | 162/158 |
| 4,214,948 | A | 7/1980 | Mazzarella et al. | 162/158 |
| 4,222,820 | A | 9/1980 | Hiskens et al. | 162/158 |
| 4,301,017 | A | 11/1981 | Kightlinger et al. | 252/8.6 |
| 4,522,686 | A | 6/1985 | Dumas | 162/158 |
| 4,560,724 | A | 12/1985 | Brabetz et al. | 524/734 |
| 4,721,655 | A | 1/1988 | Trzasko et al. | 428/530 |
| 4,835,212 | A | 5/1989 | Degen et al. | 524/734 |
| 4,855,343 | A | 8/1989 | Degen et al. | 524/47 |
| 4,859,720 | A | 8/1989 | Flesher et al. | 523/332 |
| 4,919,724 | A | 4/1990 | Cenisio et al. | 106/199 |
| 5,013,775 | A | 5/1991 | Oikawa et al. | 524/107 |
| 5,116,924 | A | 5/1992 | Bung et al. | 526/312 |
| 5,169,886 | A | 12/1992 | Bung et al. | 524/238 |
| 5,190,584 | A | 3/1993 | Ruffini | 106/243 |
| 5,397,436 | A | 3/1995 | Robeson et al. | 162/158 |
| 5,456,800 | A | 10/1995 | Tansley et al. | 162/158 |
| 5,498,648 | A | 3/1996 | deClercq et al. | 524/47 |
| 5,510,003 | A | 4/1996 | Colasurdo et al. | 162/158 |
| 5,595,631 | A | 1/1997 | Tsai et al. | 162/175 |
| 5,626,719 | A | 5/1997 | Tansley et al. | 162/158 |
| 5,685,815 | A | 11/1997 | Bottorff et al. | 493/186 |
| 5,725,731 | A | 3/1998 | Brungardt et al. | 162/72 |
| 5,766,417 | A | 6/1998 | Brugnardt | 162/158 |
| 5,846,663 | A | 12/1998 | Brungardt et al. | 428/537.5 |
| 5,853,542 | A | 12/1998 | Bottorff | 162/168.2 |
| 5,972,094 | A | * 10/1999 | Bates et al. | 106/145.1 |
| 6,051,107 | A | 4/2000 | Varnell | 162/135 |

FOREIGN PATENT DOCUMENTS

| | | | |
|---|---|---|---|
| DE | 3235529 | A1 | 3/1984 |
| GB | 1504853 | | 3/1978 |
| JP | 59053799(84) | A | 3/1984 |
| JP | 91068158 | B | 9/1985 |
| JP | 168991/89 | | 7/1989 |
| JP | 168992/89 | | 7/1989 |
| JP | 4107564 | A | 4/1992 |
| JP | 60737993)94) | A | 3/1994 |
| JP | 7119082 | A | 5/1995 |
| JP | 2684983 | B2 | 8/1995 |
| JP | 9-228293 | | 9/1997 |
| WO | WO97/35068 | | 9/1997 |
| WO | WO 97/37079 | | 10/1997 |
| WO | WO 97/41186 | | 11/1997 |
| WO | WO99/16975 | | 4/1999 |
| WO | WO99/54548 | | 10/1999 |

OTHER PUBLICATIONS

C.F. Farley and R.B. Wasser, "The Sizing of Paper, Second Edition," edited by W.F. Reynolds, Tappi Press, 1989, pp. 51–62.

* cited by examiner

*Primary Examiner*—James J. Seldleck
*Assistant Examiner*—U. K. Rajguru
(74) *Attorney, Agent, or Firm*—Martin F. Sloan

(57) ABSTRACT

There is disclosed a process for preparing an aqueous size composition by emulsifying a cellulose reactive size not solid at 25° C. into a starch stabilized aqueous polymer dispersion. The emulsification is carried out at a temperature substantially lower than 70° C.

52 Claims, No Drawings

METHOD FOR PREPARING AQUEOUS SIZE COMPOSITION

FIELD OF THE INVENTION

This invention relates to processes for making aqueous paper size compositions.

BACKGROUND OF THE INVENTION

Current applications for fine paper require particular attention to sizing before conversion or end-use, such as high speed photocopies, envelopes, forms bond, including computer paper, and adding machine paper. Paper is conventionally sized by addition of sizing agents to the "wet end" of the paper process (internal addition), i.e., to the pulp before sheet formation, or by addition of sizing agents to the surface of already formed paper sheet that has been at least partially dried (surface sizing).

Alkyl ketene dimers (AKD's) and alkenylsuccinic anhydrides are widely used paper sizing agents. Although they are described in the literature as being useful for both internal and surface sizing, they are generally not used for surface sizing commercially. Cellulose reactive sizes, such as ketene dimers and alkenylsuccinic anhydrides display high sizing efficiency, but may cause problems in size reversion, toner adhesion and high speed paper converting. Variable coefficient of friction is at least one factor leading to the problems in high speed converting operations.

Recently alkenyl ketene dimers and ketene multimers have been described that are useful for internal and surface sizing and that overcome the deficiencies in high speed converting. These materials are disclosed in U.S. Pat. Nos. 5,846,663 and 5,685,815, both of which are incorporated herein by reference in their entireties. Precis®2000 and Precis®3000 sizing agents (available from Hercules Incorporated, Wilmington, Del.) are examples of such sizes. They are widely used commercially for internal sizing, but not for surface sizing because they do not contribute to good toner adhesion and other surface properties.

Cellulose non-reactive sizes have been used for some time as surface sizes. Examples of such materials are starch and other polymeric sizes such as copolymers of styrene with vinyl monomers such as maleic anhydride, acrylic acid and its alkyl esters, acrylamide, etc. In particular, styrene/maleic anhydride resins are widely used for surface sizing. Cellulose non-reactive sizes generally exhibit improved toner adhesion, little or no effect on coefficient of friction, no effect, or an improved effect on high speed converting, and no size reversion when compared to reactive sizes; however, they are less efficient at sizing than the reactive sizes.

As a result of all of the above, most papers at the present time are internally sized with alkenylsuccinic anhydride, alkyl ketene dimers, alkenyl ketene dimers or rosin sizes.

Co-pending patent application Ser. No. 08/940,514, filed Sep. 30, 1997, which is incorporated herein by reference in its entirety, discloses that treatment of paper with a combination of reactive and non-reactive sizes can produce paper with a unique balance of final properties that cannot be achieved by using either of the size types alone. The combination of cellulose reactive and cellulose non-reactive sizes provides paper that exhibits better water holdout than paper that is the same except that the sizing composition contains only cellulose non-reactive size. The combination size also provides paper that performs better in ink jet printing than does paper that is the same except that the size composition contains only cellulose reactive or only cellulose non-reactive size. Furthermore, the paper exhibits better toner adhesion, higher coefficient of friction and a lower coefficient of friction bandwidth than does paper that is the same except that the size composition contains only cellulose reactive size. The paper is also capable of performing effectively in tests that measure its convertibility on state-of-the-art converting equipment and its performance on high speed end-use machinery.

U.S. Pat. No. 5,498,648 discloses paper size mixtures which are prepared by mixing an aqueous suspension of a digested cationic starch with a finely divided, aqueous polymer dispersion which is a paper size and emulsifying $C_{14}$–$C_{22}$-alkyldiketene in this mixture at not less than 70° C.

SUMMARY OF THE INVENTION

It is an object of the invention to provide a novel process for preparing an aqueous size composition comprising at least one cellulose reactive size that is not solid at 25° C., and at least one polymer.

In one embodiment the invention relates to a process for preparing an aqueous size composition comprising: a) providing a cellulose reactive size not solid at 25° C., and a starch stabilized aqueous polymer dispersion; and b) emulsifying the cellulose reactive size into the aqueous polymer dispersion.

In another embodiment the invention relates to a process for preparing an aqueous size composition comprising: a) providing a cellulose reactive size comprising ketene dimer or multimer not solid at 25° C. that is a mixture of compounds having the structure:

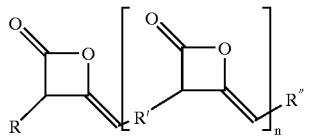

wherein n is an integer of 0 to about 20, R and R", which may be the same or different, are saturated or unsaturated straight chain or branched alkyl groups having 6 to 24 carbon atoms; and R' is a saturated or unsaturated straight chain or branched alkyl group having from about 2 to about 40 carbon atoms, and wherein at least 25% of the R and R" groups is unsaturated; b) providing a starch stabilized aqueous dispersion of a polymer having a weight average molecular weight greater than about 10,000, comprising a water-insoluble copolymer made from monomers comprising styrene or substituted styrene, alkyl acrylate or methacrylate and ethylenically unsaturated carboxylic acid, wherein the styrene or substituted styrene is selected from the group consisting of styrene, α-methylstyrene, vinyl toluene and mixtures thereof, wherein the alkyl group of the alkyl acrylate or methacrylate contains from 1 to about 12 carbon atoms and wherein the ethylenically unsaturated carboxylic acid is selected from the group consisting of acrylic acid, methacrylic acid, maleic acid or anhydride, fumaric acid, itaconic acid and mixtures thereof; and c) emulsifying the cellulose reactive size into the aqueous dispersion of polymer at a temperature of from about 20° C. to about 60° C.

DETAILED DESCRIPTION OF THE INVENTION

Cellulose reactive sizes are defined as those sizes believed to be capable of forming covalent chemical bonds by reaction with the hydroxyl groups of cellulose, and cellulose non-reactive sizes are defined as those that do not form these covalent bonds with cellulose.

Cellulose reactive sizes for use in the invention include ketene dimers and multimers, alkenylsuccinic anhydrides, organic epoxides, acyl halides, fatty acid anhydrides, and organic isocyanates, all of which that are not solid at 25° C.

A preferred group of cellulose reactive sizes for use in the invention includes ketene dimers and multimers that are not solid at 25° C. (not substantially crystalline, semi-crystalline or waxy solid; i.e., they flow on heating without heat of fusion). More preferably they are not solid at 20° C. Even more preferably they are liquid at 25° C., and most preferably liquid at 20° C. These liquid dimers and multimers are mixtures of compounds of formula I in which n is preferably 0 to 6, more preferably 0 to 3, and most preferably 0; R and R", which can be the same or different, are saturated or unsaturated, straight chain or branched alkyl groups having 6 to 24 carbon atoms; R' is a saturated or unsaturated, straight chain or branched alkyl group having 2 to 40 carbon atoms, preferably 4 to 32 carbon atoms; and wherein at least 25% of the R and R" groups in the mixture of compounds is unsaturated.

(1)

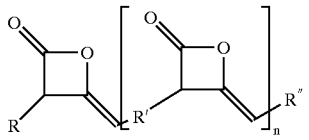

Ketene dimers for use in the process of this invention are mixtures of compounds having the structure of formula 1 where n=0 and the R and R" groups, which can be the same or different, are hydrocarbon radicals and where at least 25% of the R and R" groups in the mixture of compounds is unsaturated.

The ketene dimers and multimers not solid at 25° C. may comprise a mixture of ketene dimer or multimer compounds that are the reaction product of a reaction mixture comprising unsaturated monocarboxylic fatty acids. The reaction mixture may further comprise saturated monocarboxylic fatty acids and dicarboxylic acids. Preferably the reaction mixture for preparing the mixture of dimer or multimer compounds comprises at least 25 wt. % unsaturated monocarboxylic fatty acids, and more preferably at least 70 wt. % unsaturated monocarboxylic fatty acids.

The unsaturated monocarboxylic fatty acids included in the reaction mixture preferably have 10–26 carbon atoms, more preferably 14–22 carbon atoms, and most preferably 16–18 carbon atoms. These acids include, for example, oleic, linoleic, dodecenoic, tetradecenoic (myristoleic), hexadecenoic (palmitoleic), octadecadienoic (linolelaidic), octadecatrienoic (linolenic), eicosenoic (gadoleic), eicosatetraenoic (arachidonic), cis-13-docosenoic (erucic), trans-13-docosenoic (brassidic), and docosapentaenoic (clupanodonic) acids, and their acid halides, preferably chlorides. One or more of the monocarboxylic acids may be used. Preferred unsaturated monocarboxylic fatty acids are oleic, linoleic, linolenic and palmitoleic acids, and their acid halides. Most preferred unsaturated monocarboxylic fatty acids are oleic and linoleic acids, and their acid halides.

The saturated monocarboxylic fatty acids used to prepare the ketene dimer and multimer compounds used in this invention preferably have 10–26 carbon atoms, more preferably 14–22 carbon atoms, and most preferably 16–18 carbon atoms. These acids include, for example, stearic, isostearic, myristic, palmitic, margaric, pentadecanoic, decanoic, undecanoic, dodecanoic, tridecanoic, nonadecanoic, arachidic and behenic acids, and their halides, preferably chlorides. One or more of the saturated monocarboxylic fatty acids may be used. Preferred acids are palmitic and stearic.

The alkyl dicarboxylic acids used to prepare the ketene multimer compounds for use in this invention preferably have 6–44 carbon atoms, and more preferably 9–10, 22 or 36 carbon atoms. Such dicarboxylic acids include, for example, sebacic, azelaic, 1,10-dodecanedioic, suberic, brazylic, docosanedioic acids, and $C_{36}$ dimer acids, e.g. EMPOL 1008 available from Henkel-Emery, Cincinnati, Ohio, U.S.A, and their halides, preferably chlorides. One or more of these dicarboxylic acids can be used. Dicarboxylic acids with 9–10 carbon atoms are more preferred. The most preferred dicarboxylic acids are sebacic and azelaic acids.

When dicarboxylic acids are used in the preparation of the ketene multimers for use in this invention, the maximum mole ratio of dicarboxylic acid to monocarboxylic acid (the sum of both saturated and unsaturated) is preferably about 5. A more preferred maximum is about 4, and the most preferred maximum is about 2.

The mixture of dimer and multimer compounds may be prepared using methods known for the preparation of standard ketene dimers. In the first step, acid halides, preferably, acid chlorides, are formed from a mixture of fatty acids, or a mixture of fatty acids and dicarboxylic acid, using $PCl_3$ or another halogenating, preferably chlorinating, agent. The acid halides are then converted to ketenes in the presence of tertiary amines (including trialkyl amines and cyclic alkyl amines), preferably triethylamine. The ketene moieties dimerize to form the desired compounds.

Ketene dimers not solid at 25° C. are available in the form of aqueous dispersions as Precise sizing agents, from Hercules Incorporated, Wilmington, Del.

Also included in the group of cellulose reactive sizes not solid at 25° C. are alkenylsuccinic anhydrides (ASA). ASA's are composed of unsaturated hydrocarbon chains containing pendant succinic anhydride groups. They are usually made in a two-step process starting with alpha olefin. The olefin is first isomerized by randomly moving the double bond from the alpha position. In the second step the isomerized olefin is reacted with maleic anhydride to give the final ASA of formula 2. Typical olefins used for the reaction with maleic anhydride include alkenyl, cycloalkenyl and aralkenyl compounds containing from about 8 to about 22 carbon atoms. Specific examples are isooctadecenyl succinic anhydride, n-octadecenyl succinic anhydride, n-hexadecenyl succinic anhydride, n-dodecyl succinic anhydride, i-dodecenyl succinic anhydride, n-decenyl succinic anhydride and n-octenyl succinic anhydride.

(2)

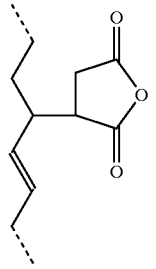

Alkenylsuccinic anhydrides are disclosed in U.S. Pat. No. 4,040,900, which is incorporated herein by reference in its entirety, and by C. E. Farley and R. B. Wasser in *The Sizing of Paper, Second Edition,* edited by W. F. Reynolds, Tappi Press, 1989, pages 51–62. A variety of alkenylsuccinic anhydrides is commercially available from Albemarle Corporation, Baton Rouge, La. Alkenylsuccinic anhydrides for use in the invention are preferably liquid at 25° C. More preferably they are liquid at 20° C.

Preferred cellulose reactive sizes for use in the invention are ketene dimers and multimers, more preferably ketene dimers, of structure 1 that are not solid at 25° C. (not substantially crystalline, semi-crystalline or waxy solid; i.e., they flow on heating without heat of fusion). Even more preferably they are not solid at 20° C., yet more preferably liquid at 25° C.; and most preferably liquid at 20° C.

The polymers for use in dispersion form in the present invention preferably have a molecular weight greater than about 1,500. More preferably the molecular weight is greater than about 5,000, and most preferably greater than about 10,000.

The polymers for use in the invention preferably have a primary glass transition temperature ($T_G$) of less than about 100° C. as a neat blend, i.e., free of water or solvent, with the cellulose reactive size of the size composition. More preferably the primary $T_G$ of the neat blend is less than about 60° C., and most preferably less than about 40° C. "Primary glass transition temperature" is the glass transition temperature corresponding to the highest heat capacity change observed during determination of $T_G$.

The polymers include, but are not limited to, copolymers of styrene or substituted styrenes with vinyl monomers. Examples of such vinyl monomers include, but are not restricted to maleic anhydride, acrylic acid or its alkyl esters, methacrylic acid or its alkyl esters, itaconic acid, divinyl benzene, acrylamide, acrylonitrile, cyclopentadiene and mixtures thereof. Also included are polyurethanes and copolymers of ethylene with comonomers such as vinyl acetate, acrylic acid and methacrylic acid.

Preferred polymers are copolymers made from monomers comprising styrene or substituted styrene, alkyl acrylate or methacrylate and ethylenically unsaturated carboxylic acid, where the styrene or substituted styrene is selected from the group consisting of styrene, α-methylstyrene, vinyl toluene and mixtures thereof, where the alkyl group of the alkyl acrylate or methacrylate contains from 1 to about 12 carbon atoms and where the ethylenically unsaturated carboxylic acid is selected from the group consisting of acrylic acid, methacrylic acid, maleic acid or anhydride, fumaric acid, itaconic acid and mixtures thereof. These copolymers are described in copending patent application Ser. No. 08/847,841 filed Apr. 28, 1997, which is incorporated herein by reference in its entirety.

The aqueous polymer dispersions for use in the invention are stabilized with starch. The starch utilized may be any of the conventionally used starches, e.g. unmodified starch, cationic starch, anionic starch, ethylated starch, pearl starch. A preferred class of starch stabilized non-reactive sizes is that containing polymers formed by emulsion polymerization in the presence of starch, resulting in polymer grafted to the starch. Examples of such materials are disclosed in U.S. Pat. Nos. 4,301,017; 4,560,724; 4,835,212 and 4,855,343, all of which are incorporated by reference herein in their entireties. A preferred composition in this class of polymers grafted to starch is one which is made from monomers comprising styrene, and/or acrylonitrile combined with acrylate or methacrylate ester. Examples of such materials are Basoplast® 250D and Basoplast® 335D, available from BASF Corporation, Charlotte, N.C.

Other preferred copolymer dispersions are Chromaset® 700 surface sizing treatment, available from Hercules Incorporated, Wilmington, Del. and Basoplast 400® DS, available from BASF Corporation, Charlotte, N.C.

The processes of the invention comprise emulsifying the cellulose reactive size into the aqueous polymer dispersion. Preferably, the emulsification temperature is substantially lower than 70° C., more preferably from about 20° C. to about 60° C., even more preferably from about 20° C. to about 45° C., and most preferably from about 20° C. to about 30° C. These low emulsification temperatures reduce the chance that the reactive size will undergo unwanted reaction with water and thus become unavailable for sizing.

Another advantage of the current invention is that no additional emulsifiers or surfactants are necessary. This provides an advantage when the products are used for sizing paper because emulsifiers and surfactants can be detrimental to sizing.

The emulsification step can be carried out by any of the conventional emulsification processes, e.g., sonication or homogenization. It has been found in practicing the invention that the total solids level of the aqueous size dispersions has an effect on the stability of the compositions. For optimum stability the minimum solids level is preferably about 30%, and more preferably about 35%. The most preferable minimum solids level is about 40%. A preferred maximum solids level is about 60%. The most preferred maximum solids level is about 55%.

The ratio, on a dry basis, of cellulose reactive size to polymer in the aqueous size compositions may be important for use of the compositions in sizing paper, but is not critical for preparing the compositions by the methods described herein. The ratio preferably has a minimum value of about 0.2:1. More preferably the minimum is about 0.25:1, and most preferably about 0.33:1. The maximum ratio is preferably about 5:1, more preferably about 4:1 and most preferably about 3:1.

When the amount of polymer is high relative to cellulose reactive size in the aqueous size composition, it may be advantageous to use a polymer that is itself a size. For the purpose of this disclosure "sizes" are defined as materials that provide upon addition to paper at a size press, in combination with a typical oxidized starch (e.g. D150 starch from Grain Processing Corporation, Muscatine, Iowa), applied at a level of 4 wt. % on a dry basis based on dry paper weight, an increase of sizing as measured by the Hercules Sizing Test (HST) method over the same paper treated with only starch at the same 4% level. The HST method is described in TAPPI Standard T530. Specifically, for the purposes of this disclosure a material is a size if it meets at least one the following tests:

1) addition of surface sizing agent at a level of 0.15% on a dry basis based on dry paper weight, with starch, as noted above, to a 75 g/m$^2$ base sheet containing a 75/25 hardwood/softwood bleached pulp mixture refined to give a freeness of 425 CSF (Canadian Standard Freeness) and containing the following additives added at the wet-end of the paper machine: 15% precipitated calcium carbonate filler (Albacar® HO, available from Specialty Minerals Inc., Bethlehem, Pa.), 0.5% cationic starch (Sta-Lok® 400 from Staley Manufacturing Co., Decatur, Ill.), and 0.05% of an alkyl ketene dimer internal sizing agent such as Hercon® 70 (available from Hercules Incorporated, Wilmington, Del.), all percentages being on a dry active basis based on final dry paper weight. The sizing increase must be at least 20 seconds (average of at least 6 repetitions);

2) addition of surface sizing at a level of 0.25% on a dry basis based on the dry weight of paper, with starch as noted above to a 75 g/m$^2$ base sheet containing a 75/25 hardwood/softwood bleached pulp mixture refined to give a freeness of 425 CSF and containing the following additives added at the wet-end of the paper machine: 15% precipitated calcium carbonate filler (Albacar® HO), 0.5% cationic starch (Sta-Lok® 400) and no internal sizing agent. All percentages being on a dry active basis based on final dry paper weight. The sizing increase must be at least 5 seconds (average of at least 6 repetitions).

The stability of the aqueous size compositions can be assessed in several ways all of which are aimed at predicting storage stability, pump stability and application feasibility. One stability test assesses heat stability by determining the change in viscosity upon aging at 32° C. Utilizing this test it is found that the viscosities of the size compositions of the invention preferably remain below about 200 cps after 4 weeks aging. Another stability test measures the amount of separation or "creaming" upon storage by measuring the change in the solids level of the top layer ("top solids") of the composition as time progresses as compared with the solids level of the starting bulk composition. When measured in this manner it is found that the change in top solids level may range from 0 to about 5.0% after storage of the compositions for 4 weeks.

This invention is illustrated by the following examples, which are exemplary only and not intended to be limiting. All percentages, parts, etc., are by weight, unless otherwise indicated.

Procedures

Viscosity: Brookfield viscosities of the aqueous size compositions were determined at 6, 12, 30 and 60 rpm.

Heat Stability: Samples of the aqueous size compositions were aged at 32° C. The Brookfield viscosity (60 rpm) was measured at one week intervals. Criteria for satisfactory heat stability were lack of gel and a viscosity less than about 200 cps after 4 weeks aging.

Separation: The amount of separation was determined by measuring the change in solids level of the top layer of a sample of size composition stored for up to 4 weeks. Satisfactory levels of separation were considered to be less than about a 5% change.

Deposition Test: The deposition test was devised in order to evaluate the size composition emulsions for stability at the size press. The deposition test was carried out as follows:

Step 1: Starch Cook

An 8% starch solution in 50 ppm hard water was prepared with $CaCl_2$ and deionized water. (0.077 g $CaCl_2$*H2O and 999.023 g water). The starch was cooked by stirring and heating to 95° C. for 45 minutes. The starch solution was never allowed to cool below 50° C. (typically it was kept at 65° C.); it was used hot; and it was used on the same day it was prepared. Sodium chloride (at a level of 0.65% by weight of the starch solution) was added to the starch solution at end of the starch cook.

Step 2: Equipment Set-Up

A weighed 14 mesh screen of 0.5"×1.75" was placed in a rubber tubing holder (⅝" OD pressure tubing slit half way up lengthwise) and secured with a rubber band. The tubing was placed in the hollow bottom of a glass stopper, and then the stopper was placed in a 250 ml 3-neck round bottom flask along with an overhead stirrer connected to a paddle stirrer and thermocouple. The screen was placed so that it protruded down into the flask so that the solution would stir through it and so that it would not hit stirrer. The flask was placed in a 65° C. water bath.

Step 3: Solution Preparation

The starch solution was cooled to approximately 65° C., and the pH was adjusted to mimic the size press solution (typically 8.0). To 200 grams of starch solution were added: defoamer (typically 0.04 grams) and the sizing agents (typically from 0.6 to 1 gram, based on solids level). If necessary, the pH was then adjusted back to 8.

Step 4: Deposition Test

To the flask prepared as in Step 2 there was added 200 grams of the starch solution with the additives. Stoppers and thermocouples were inserted into the flask, which was then stirred at 500 rpm and 65° C. for 2 hours.

Step 5: Analysis

After 2 hours, stopper and screen were removed The screen was gently rinsed 5 times with water using a squeeze bottle, alternately rinsing sides of the screen. It was then allowed to dry overnight and weighed on the next day. Any grit in the solution at the end of the test was determined by passing solution through approximately a 125 mesh filter. Also the sides of the flask were inspected for deposits.

A weight gain on the screen of greater than 2 mg is considered a failure.

Materials

Aqueous Polymer Dispersions

Chromaset® 700, surface sizing treatment: a starch stabilized poly(styrene/acrylic acid/acrylate ester) latex, available either at solids level 24–26%, pH 5.5–6.5 or at solids level 33–35%, pH 4–5, from Hercules Incorporated, Wilmington, Del.

Basoplast® 400DS: styrene/butyl acrylate copolymer latex, stabilized with starch, available from BASF Corporation, Charlotte, N.C.

Cellulose Reactive Sizes

Liquid ketene dimer was prepared by methods known from Japanese patent applications 168991/89 and 168992/89. In the first step, acid chlorides from a mixture of fatty acids are formed using phosphorous trichloride or other conventional chlorination agent, and the acid chlorides are dehydrochlorinated in the presence of triethylamine or other suitable base. The fatty acid mixture was composed of approximately 51 % oleic acid, 45% linoleic acid,1 % palmitoleic acid, the remainder being a mixture of saturated and unsaturated fatty acids, rosin acids and unsaponifiable materials.

EXAMPLE 1

This example describes preparation of a 2:1 (on a dry basis), liquid ketene dimer/Chromaset® 700 size composition by emulsification of the ketene dimer into the latex.

Liquid ketene dimer (170 g), Chromaset® 700 (257.6 g, 85 g active solids) and 36 g of water were added to a Waring Blender jar and sheared on "high" for approximately 3 seconds to form a premix. The premix was then transferred to a plastic beaker containing a magnetic stirrer. The premix was then sonicated in a Branson Sonifier 450 at 165 watts for 60 seconds with mixing at room temperature. The resulting white emulsion was filtered through a 226 micron paint filter into a jar. The solids level was 53.2%.

Properties of the Emulsion

Rheology (By Brookfield Viscometer):

| Rpm | viscosity |
|---|---|
| 6 | 225 cps |
| 12 | 175 |
| 30 | 122 |
| 60 | 93 |

Pseudoplastic Slope = −0.372
k intercept = 442 cps

Particle size: 438.6 nm effective diameter

Zeta Potential: −49.1 mvolts (at pH 5.5)

Heat Stability (Viscosity at 60 rpm, Heat Aging at 32° C.):

| | |
|---|---|
| 1 wk | 100 cps |
| 2 wks | 100 cps |
| 3 wks | 100 cps |
| 4 wks | 170 cps |

Separation (By Measuring Top Solids vs Aging Time):

| | |
|---|---|
| 1 wk | 53.2% |
| 2 wks | 53.4% |
| 3 wks | 55.1% |
| 4 wks | 55.8% |

The Deposition Test was performed on this size composition by the procedures described above. Conditions were varied as follows:

A) Normal Conditions:

| | |
|---|---|
| Starch | 8% Cato ® 52A |
| Water hardness | 50 ppm |
| % NaCl | 0.3 |
| % Optical Brightener | none |
| Defoamer | 0.005% Foamtrol ® 2000 |
| % Polymer | 0.15 |
| % Dimer | 0.30 |
| Size Press pH | 8 |
| Temperature | 65° C. |
| Time | 2 hours |

Result: No particle build-up or foam in the flask. The screen weight gain was 0.2 mg (failure was considered any gain above 2.0 mg).

B) Severe Conditions:

| | |
|---|---|
| Starch | 8% Cato 52A |
| Water hardness | 100 ppm |
| % NaCl | 0.5 |
| % Optical Brightener | 0.2 |
| Defoamer | 0.01% Advantage ® M 1251 |

-continued

| | |
|---|---|
| % Polymer | 0.30 |
| % Dimer | 0.60 |
| Size Press pH | 8 |
| Temperature | 75° C. |
| Time | 2 hours |

Result: No particle build-up or foam in the flask. The screen weight gain was 0.5 mg C) Normal Conditions, using Ethylex® 2025 starch in place of Cato 52A:

Result: No particle build-up or foam in the flask. The screen weight gain was0.2 mg D) Severe conditions, using Ethylex 2025 starch in place of Cato 52A:

Result: Particles were seen in the flask. The screen weight gain was 19.3 mg.

E) Normal conditions, using D 150 Oxidized starch in place of Cato 52A:

Result: Particle build-up was seen in flask. The screen weight gain was 0.7 mg.

F) Severe conditions, using D 150 Oxidized starch in place of Cato 52A:

Result: Particle build-up was seen in flask. The screen weight gain was 1.1 mg.

G) Severe conditions, Cato 52A starch, pH 6 in place of pH 8:

Result: Particle build-up was seen in flask. The screen weight gain was 25.4 mg.

H) Severe conditions, Cato 52A starch, pH 8,300 ppm alum:

Result: Slight particle build-up was seen in flask. The screen weight gain was 1.7 mg.

I) Severe conditions, Cato 52A starch, 300 ppm water hardness:

Result: No particles seen in flask. The screen weight gain was 6.4 mg.

Note: A weight gain of over 2 mg is considered a failure.

EXAMPLE 2

This example is essentially the same as Example 1 with the exception that a Mantin-Gaulin homogenizer was used for emulsification instead of sonication.

Liquid ketene dimer (340 g), Chromaset® 700 (515 g, 170 g active solids) and 72 g of water were added to a Waring Blender jar and sheared on "high" for approximately 3 seconds to form a premix. The premix was then passed through the Mantin Gaulin homogenizer at 3000 psi, at room temperature. In order to prevent dilution by the water in the "dead space" of the homogenizer, the homogenizer was drained and a second "premix" batch was passed through. The white emulsion had a final solids level of 54.3%.

Properties of the Emulsion

Rheoloay (By Brookfield Viscometer):

| Rpm | viscosity |
|---|---|
| 6 | 215 cps |
| 12 | 165 |
| 30 | 116 |
| 60 | 90 |

Pseudoplastic Slope=−0.367 k intercept=415 cps

Particle size: 434.6 nm effective diameter

Zeta Potential: −44.4 mvolts

Heat Stability (Viscosity at 60 rpm, Heat Aging at 32° C.):

| | |
|---|---|
| 1 wk | 100 cps |
| 2 wks | 115 cps |
| 3 wks | 125 cps |
| 4 wks | 125 cps |

Separation (By Measuring Top Solids vs Aging Time):

| | |
|---|---|
| 1 wk | 54.3% |
| 2 wks | 54.8% |
| 3 wks | 55.1% |
| 4 wks | 56.9% |

EXAMPLE 3

This example describes preparation of a 1:1 (on a dry basis), liquid ketene dimer/Chromaset® 700 size composition by emulsification of the ketene dimer into the latex.

Liquid ketene dimer (137.5 g), Chromaset® 700 (416.6 g, 137.5 g active solids, pH 4–5)) and 2.8 g of biocide were added to a plastic beaker containing a magnetic stirring bar. While being mixed rapidly, the contents of the beaker were sonicated in a Branson Sonifier at 450 at 65 watts for 2 minutes. The resulting white emulsion was filtered through a 226 micron paint filter into a jar. The solids level was 49%.

Properties of the Emulsion

Rheology (By Brookfield Viscometer):

| Rpm | viscosity |
|---|---|
| 6 | 100 cps |
| 12 | 100 |
| 30 | 80 |
| 60 | 70 |

Pseudoplastic Slope=−0.162 k intercept=140 cps pH=3.8

Particle size: 308.9 nm effective diameter

Zeta Potential : −47.8 mvolts (at pH 6.7)

Heat Stability (Viscosity at 60 rpm, Heat Aging at 32° C.):

| | |
|---|---|
| 1 wk | 75 cps |
| 2 wks | 83 cps |
| 3 wks | 265 cps |

Separation (By Measuring Top Solids Vs Aging Time):

| | |
|---|---|
| 1 wk | 48.6% |
| 2 wks | 48.4% |
| 3 wks | 48.6% |

The heat stability was not as good on this product as it was on the products of Examples 1 and 2. However, the size composition would be sufficiently stable for use within 3 weeks of manufacture.

EXAMPLE 4

This example describes preparation of a 1:2 (on a dry basis), liquid ketene dimer/Chromaset® 700 size composition by emulsification of the ketene dimer into the latex.

Liquid ketene dimer (70 g), Chromaset® 700 (424.2 g, 140 g active solids, pH 4–5) and 2.5 g of biocide were emulsified by the same procedure described in Example 3. The resulting white emulsion was filtered through a 226 micron paint filter into a jar. The solids level was 42.8%.

Properties of the Emulsion

Viscosity=30 cps pH=2.9

Particle size: 266.9 nm effective diameter

Zeta Potential: −37.2 mvolts (at pH 4.9)

Separation (By Measuring Top Solids vs Aging Time):

4 wks 42.9

EXAMPLE 5

A size composition was made at the 2/1 ratio (on a dry basis) of liquid ketene dimer to latex using Chromaset®700 (25% solids) as the latex polymer by the procedure described in Example 1. The following characteristic properties were observed:

| | |
|---|---|
| pH: | 2.9 |
| Viscosity: | 37 cps |
| Pseudoplastic slope: | −0.240 |
| K value: | 100 cps |
| Particle size: | 349 nm |
| % solids: | 50% |

Heat Stability:

| | |
|---|---|
| 1 wk | 35 cps |
| 2 wks | 31 cps |
| 3 wks | 34 cps |
| 4 wks | 34 cps |

Separation (By Measuring Top Solids Vs Aging Time):

| | |
|---|---|
| 4 wks | 3.6% |

The emulsion was evaluated in the Deposition Test using the most severe conditions, and the results were as follows:

First deposit test ("D" test): Ethylex starch, severe, pH 6: weight gain 0.6 mg

Second deposit test ("G" test): Cato 52A starch, severe, pH 6: weight gain 0.8 mg Third deposit test ("I" test): Cato 52A, severe, pH 8, 300 ppm hardness: weight gain 0.8 mg Therefore, when severe conditions are expected, this would be the favorable system to use.

EXAMPLE 6

This example describes preparation of a 2:1 (on a dry basis), liquid ketene dimer/Basoplast® 400DS size composition by emulsification of the ketene dimer into the Basoplast latex.

Liquid ketene dimer (55.0 g), Basoplast® 400DS (113.2 g, 27.5 g active solids) were added to a plastic beaker containing a magnetic stirring bar. While being mixed rapidly, the contents of the beaker were sonicated in a Branson Sonifier at 450 at 165 watts for 2 minutes at room temperature. The solids level of the resulting emulsion was 49%.

Properties of the Emulsion

Rheology (By Brookfield Viscometer):

| Rpm | viscosity |
|---|---|
| 6 | 100 cps |
| 12 | 100 |
| 30 | 80 |
| 60 | 70 |

Pseudoplastic Slope=−0.100 k intercept=99 cps

It is not intended that the examples presented here should be construed to limit the invention, but rather they are submitted to illustrate some of the specific embodiments of the invention. Various modifications and variations of the present invention can be made without departing from the scope of the appended claims.

What is claimed is:

1. A process for preparing an aqueous size composition comprising:

a) providing a cellulose reactive size not solid at 25° C. and a starch stabilized aqueous polymer dispersion; and b) emulsifying the cellulose reactive size into the aqueous dispersion of polymeric dispersion.

2. The process of claim 1 wherein the emulsification is carried out at a temperature lower than 70° C.

3. The process of claim 1 wherein the cellulose reactive size is not solid at 20° C.

4. The process of claim 1 wherein the cellulose reactive size is liquid at 25° C.

5. The process of claim 1 wherein the cellulose reactive size is liquid at 20° C.

6. The process of claim 1 wherein the emulsification is carried out at a temperature of from about 20° C. to about 60° C.

7. The process of claim 1 wherein the emulsification is carried out at a temperature of from about 20° C. to about 45° C.

8. The process of claim 1 wherein the emulsification is carried out at a temperature of from about 20° C. to about 30° C.

9. The process of claim 1 wherein the cellulose reactive size not solid at 25° C. is selected from the group consisting of ketene dimers, ketene multimers, alkenylsuccinic anhydrides, organic epoxides, acyl halides, fatty acid anhydrides and organic isocyanates.

10. The process of claim 1 wherein the cellulose reactive size comprises alkenylsuccinic anhydride.

11. The process of claim 1 wherein the cellulose reactive size comprises ketene dimer or multimer not solid at 25° C. that is a mixture of compounds having the structure:

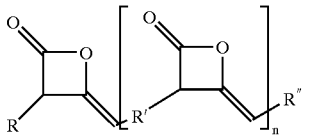

wherein n is an integer of 0 to about 20, R and R", which may be the same or different, are saturated or unsaturated straight chain or branched alkyl groups having 6 to 24 carbon atoms; and R' is a saturated or unsaturated straight chain or branched alkyl group having from about 2 to about 40 carbon atoms, and wherein at least 25% of the R and R" groups is unsaturated.

12. The process of claim 11 wherein n is 0.

13. The process of claim 11 wherein R and R" have from 10 to 20 carbon atoms and R' has from 4 to 8 or from 28 to 40 carbon atoms.

14. The process of claim 11 wherein R and R" have from 14 to 16 carbon atoms and R' has from 4 to 8 or from 28 to 40 carbon atoms.

15. The process of claim 1 wherein the polymer has a weight average molecular weight greater than about 5,000.

16. The process claim 1 wherein the polymer has a weight average molecular weight greater than 10,000.

17. The process of claim 1 wherein the polymer comprises water-insoluble polymer having a primary $T_G$ of less than about 100° C. in a neat blend with the cellulose reactive size of the size composition.

18. The process of claim 1 wherein the polymer comprises water-insoluble polymer having a primary $T_G$ of less than about 60° C. in a neat blend with the cellulose reactive size of the size composition.

19. The process of claim 1 wherein the polymer comprises water-insoluble polymer having a primary $T_G$ of less than about 40° C. in a neat blend with the cellulose reactive size of the size composition.

20. The process of claim 1 wherein the polymer is a water-insoluble polymer comprising copolymers of styrene or substituted styrenes with at least one monomer selected from the group consisting of maleic anhydride, acrylic acid, methacrylic acid, itaconic acid, acrylate esters, methacrylate esters, divinyl benzene, acrylamide, cyclopentadiene and acrylonitrile.

21. The process of claim 1 wherein the polymer is a water-insoluble polymer comprising polyurethane polymers.

22. The process of claim 1 wherein the polymer is a water-insoluble polymer comprising copolymers of ethylene with at least one monomer selected from the group consisting of vinyl acetate, acrylic acid and methacrylic acid.

23. The process of claim 1 wherein the polymer is a water-insoluble copolymer made from monomers comprising styrene or substituted styrene, alkyl acrylate or methacrylate and ethylenically unsaturated carboxylic acid, wherein the styrene or substituted styrene is selected from the group consisting of styrene, α-methylstyrene, vinyl toluene and mixtures thereof, wherein the alkyl group of the alkyl acrylate or methacrylate contains from 1 to about 12 carbon atoms and wherein the ethylenically unsaturated carboxylic acid is selected from the group consisting of acrylic acid, methacrylic acid, maleic acid or anhydride, fumaric acid, itaconic acid and mixtures thereof.

24. The process of claim 23 wherein the copolymer has a primary $T_G$ of less than about 100° C. in a neat blend with the cellulose reactive size of the size composition.

25. The process of claim 1 wherein the viscosity of the aqueous size dispersion remains below about 200 cps, and the change in top solids level is from 0 to about 5.0%, after greater than 1 week.

26. The process of claim 1 wherein the viscosity of the aqueous size dispersion remains below about 200 cps, and the change in top solids level is from 0 to about 5.0%, after greater than 2 weeks.

27. The process of claim 1 wherein the viscosity of the aqueous size dispersion remains below about 200 cps, and the change in top solids level is from 0 to about 5.0%, after greater than 3 weeks.

28. The process of claim 1 wherein the viscosity of the aqueous size dispersion remains below about 200 cps, and the change in top solids level is from 0 to about 5.0%, after greater than 4 weeks.

29. The process of claim 1 wherein the ratio on a dry basis of the cellulose reactive size to the polymer in the size composition is about 0.2:1 to about 5:1.

30. The process of claim 1 wherein the ratio on a dry basis of the cellulose reactive size to the polymer in the size composition is from about 0.25:1 to about 4:1.

31. The process of claim 1 wherein the ratio on a dry basis of the cellulose reactive size to the polymer in the size composition is from about 0.33:1 to about 3:1.

32. The process of claim 1 wherein the starch is selected from the group consisting of unmodified starch, oxidized starch, ethylated starch, anionic starch and cationic starch.

33. The process of claim 1 wherein the emulsification is carried out in the absence of added emulsifier or dispersion stabilizer.

34. The process of claim 1 wherein the total solids level of the aqueous size dispersion is from about 30% to about 60%.

35. The process of claim 1 wherein the total solids level of the aqueous size dispersion is from about 35% to about 60%.

36. The process of claim 1 wherein the total solids level of the aqueous size dispersion is from about 40% to about 55%.

37. The process of claim 1 wherein the emulsification is carried out at a temperature substantially lower than 70° C., the cellulose reactive size not solid at 25° C. is selected from the group consisting of ketene dimers, ketene multimers, alkenylsuccinic anhydrides, organic epoxides, acyl halides, fatty acid anhydrides and organic isocyanates, and the polymer is a water-insoluble polymer having a primary $T_G$ of less than about 100° C. when blended neat with the cellulose reactive size of the size composition.

38. The process of claim 1 wherein the polymer is a paper size.

39. A process for preparing an aqueous size composition comprising:

a) providing a cellulose reactive size comprising ketene dimer or multimer not solid at 25° C. that is a mixture of compounds having the structure:

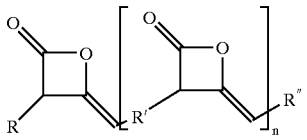

wherein n is an integer of 0 to about 20, R and R", which may be the same or different, are saturated or unsaturated straight chain or branched alkyl groups having 6 to 24 carbon atoms; and R' is a saturated or unsaturated straight chain or branched alkyl group having from about 2 to about 40 carbon atoms, and wherein at least 25% of the R and R" groups is unsaturated;

b) providing a starch stabilized aqueous dispersion of a polymer having a weight average molecular weight greater than about 10,000, comprising a water-insoluble copolymer made from monomers comprising styrene or substituted styrene, alkyl acrylate or methacrylate and ethylenically unsaturated carboxylic acid, wherein the styrene or substituted styrene is selected from the group consisting of styrene, α-methylstyrene, vinyl toluene and mixtures thereof, wherein the alkyl group of the alkyl acrylate or methacrylate contains from 1 to about 12 carbon atoms and wherein the ethylenically unsaturated carboxylic acid is selected from the group consisting of acrylic acid, methacrylic acid, maleic acid or anhydride, fumaric acid, itaconic acid and mixtures thereof; and c) emulsifying the cellulose reactive size into the aqueous polymer dispersion at a temperature of from about 20° C. to about 60° C.

40. The process of claim 39 wherein the viscosity of the aqueous size dispersion remains below about 200 cps, and the change in top solids level is from 0 to about 5.0%, after greater than 1 week.

41. The process of claim 39 wherein the viscosity of the aqueous size dispersion remains below about 200 cps, and the change in top solids level is from 0 to about 5.0%, after greater than 2 weeks.

42. The process of claim 39 wherein the viscosity of the aqueous size dispersion remains below about 200 cps, and the change in top solids level is from 0 to about 5.0%, after greater than 3 weeks.

43. The process of claim 39 wherein the viscosity of the aqueous size dispersion remains below about 200 cps, and the change in top solids level is from 0 to about 5.0%, after greater than 4 weeks.

44. The process of claim 39 wherein the ratio on a dry basis of the cellulose reactive size to the polymer in the size composition is about 0.2:1 to about 5:1.

45. The process of claim 39 wherein the ratio on a dry basis of the cellulose reactive size to the polymer in the size composition is from about 0.25:1 to about 4:1.

46. The process of claim 39 wherein the ratio on a dry basis of the cellulose reactive size to the polymer in the size composition is from about 0.33:1 to about 3:1.

47. The process of claim 39 wherein the starch is selected from the group consisting of unmodified starch, oxidized starch, ethylated starch, anionic starch and cationic starch.

48. The process of claim 39 wherein the emulsification is carried out in the absence of added emulsifier or dispersion stabilizer.

49. The process of claim 39 wherein the total solids level of the aqueous size dispersion is from about 30% to about 60%.

50. The process of claim 39 wherein the total solids level of the aqueous size dispersion is from about 35% to about 60%.

51. The process of claim 39 wherein the total solids level of the aqueous size dispersion is from about 40% to about 55%.

52. The process of claim 39 wherein the polymer is a paper size.

* * * * *